US006150770A

United States Patent [19]

Hirata et al.

[11] Patent Number: 6,150,770

[45] Date of Patent: Nov. 21, 2000

[54] FLASH APPARATUS

[75] Inventors: Shinji Hirata, Toyonaka; Hideaki Kondo, Osaka, both of Japan

[73] Assignees: Canon Kabushiki Kaisha, Tokyo; West Electric Co., Ltd., Osaka, both of Japan

[21] Appl. No.: 09/251,195

[22] Filed: Feb. 16, 1999

[30] Foreign Application Priority Data

Feb. 25, 1998 [JP] Japan ..... 10-043598
Feb. 25, 1998 [JP] Japan ..... 10-043599

[51] Int. Cl.[7] ..... H05B 37/00

[52] U.S. Cl. ..... 315/241 P; 315/151

[58] Field of Search ..... 354/141; 315/241 P, 315/151, 241 B, 241 S, 232, 240, 173, 419, 132, 237

[56] References Cited

U.S. PATENT DOCUMENTS

| | | | |
|---|---|---|---|
| 4,067,028 | 1/1978 | Lermann et al. | 354/141 |
| 4,132,923 | 1/1979 | Gahler et al. | 315/151 |
| 4,608,522 | 8/1986 | Yuasa et al. | 315/241 |
| 4,717,861 | 1/1988 | Yuasa et al. | 315/241 P |
| 5,027,039 | 6/1991 | Matsui et al. | 315/241 |

*Primary Examiner*—Don Wong
*Assistant Examiner*—Chuc Tran
*Attorney, Agent, or Firm*—Robin, Blecker & Daley

[57] ABSTRACT

In a flash apparatus capable of making high-speed repeating light emission, a self-maintaining switch element provided for various purposes is prevented from erroneously operating due to the high-speed repeating light emission, by providing a circuit element which reverse-biases a control electrode of the self-maintaining switch element.

13 Claims, 4 Drawing Sheets

FIG. 3
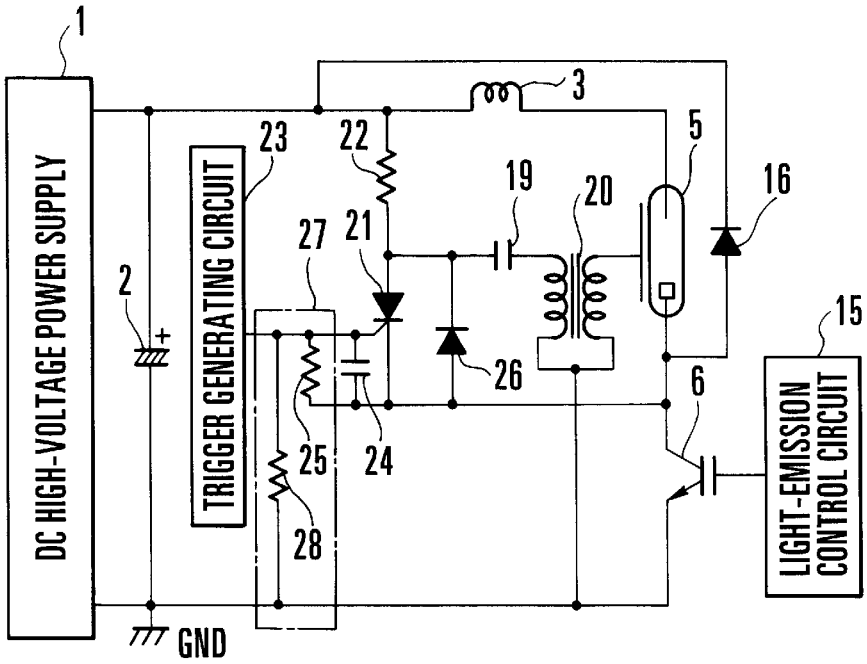
FIG. 4(a)
FIG. 4(b)
FIG. 4(c)
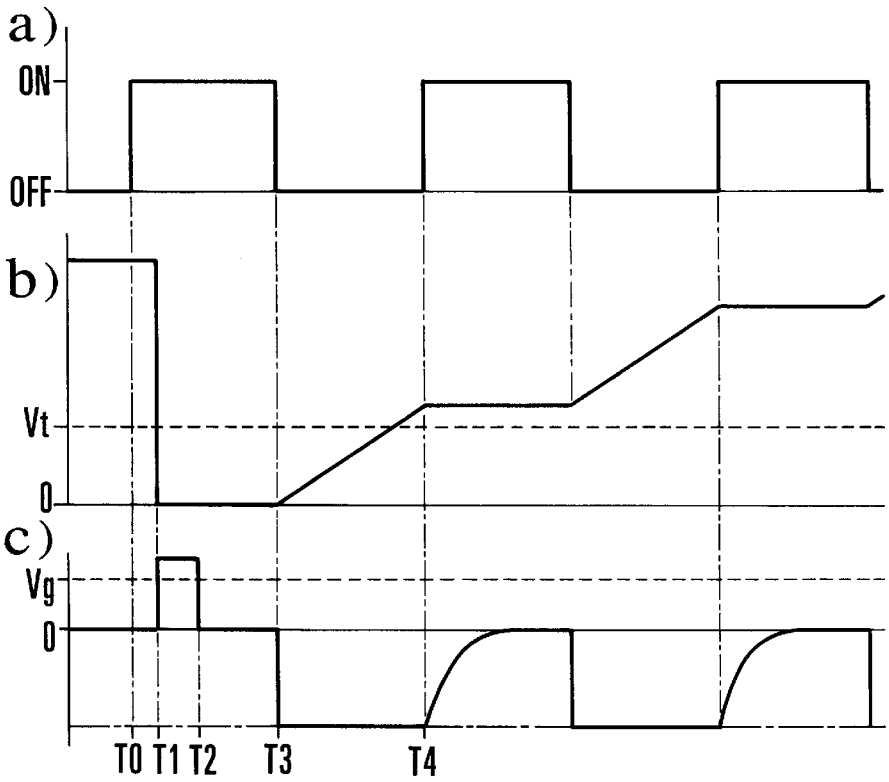

FIG. 6
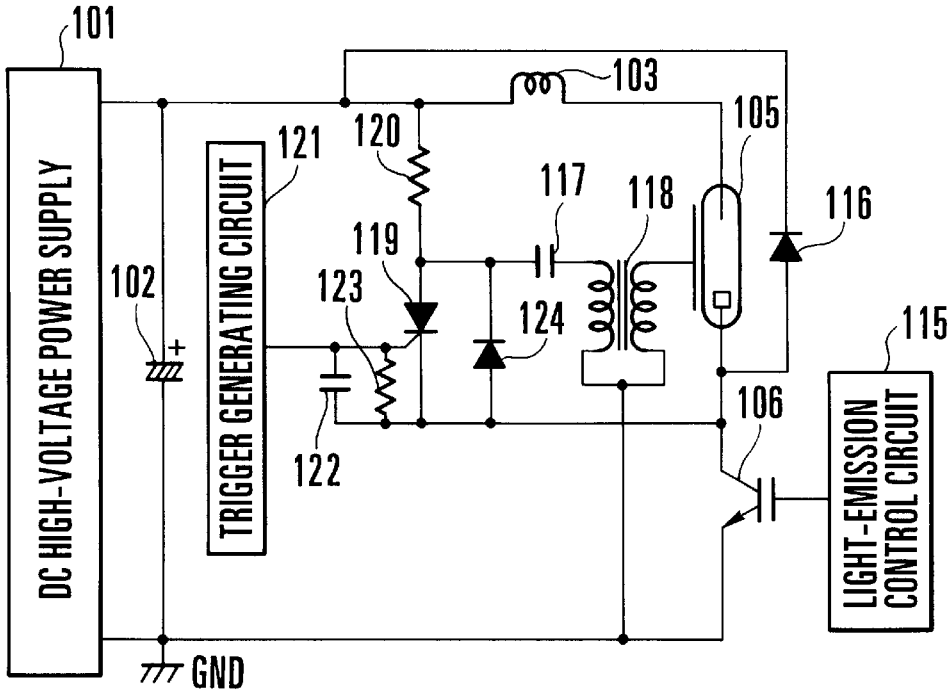
FIG. 7(a)
FIG. 7(b)
FIG. 7(c)
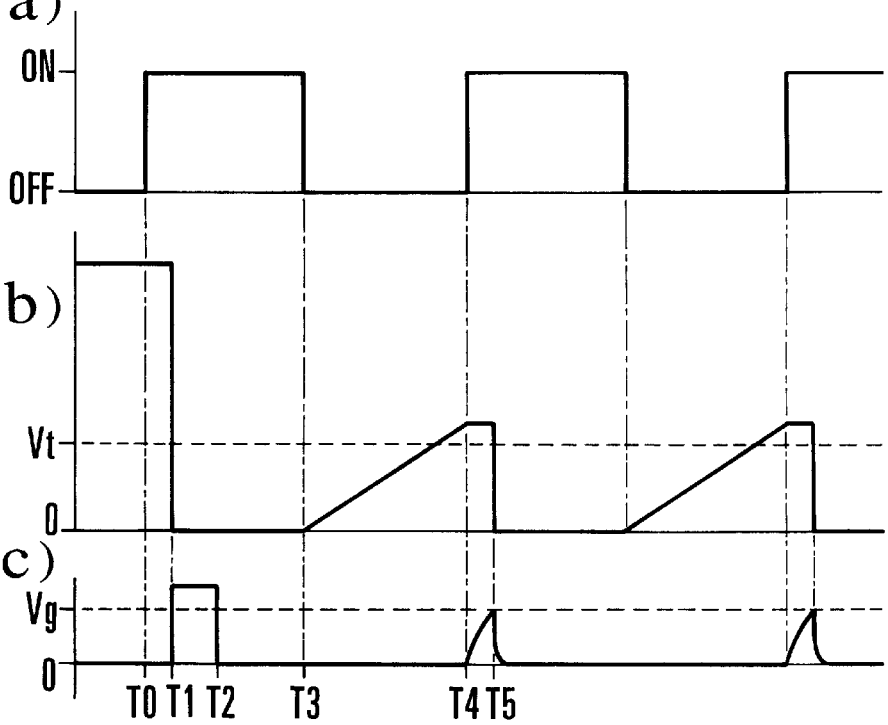

FLASH APPARATUS

BACKGROUND OF THE INVENTION

1. Field of the Invention

The present invention relates to a flash apparatus to be used as an artificial light source in taking a photograph, and more particularly, to a flash apparatus capable of making high-speed repeating light emission.

2. Description of Related Art

Flash apparatuses are popularly used in taking photographs, as artificial light sources for illuminating objects to be photographed. Some of the flash apparatuses are arranged to permit selection of the so-called flat light emission mode, in which a light emitting action is repeated at a high speed.

Meanwhile, a self-maintaining switch element such as a thyristor is used as an electric element for controlling various circuit actions in the flash apparatuses. For example, the self-maintaining switch element is used for controlling the coil connecting state (switching of coils) of the discharge loop of a main capacitor, for controlling the acting timing of a trigger circuit (starting of trigger), etc.

FIG. 5 is an electrical circuit diagram showing an example of a flash apparatus arranged to permit selection of the flat light emission mode and also to use, as a coil switching element, a thyristor which is one of self-maintaining switch elements.

Referring to FIG. 5, the flash apparatus has a DC high-voltage power supply 101 composed of a DC low-voltage power supply, such as a battery, and a DC/DC converter circuit, and a main capacitor 102 which is connected to both ends of the DC high-voltage power supply 101. To both ends of the main capacitor 102 is connected a series circuit composed of coils 103 and 104 which are a plurality of current-limiting elements, a flash tube 105, and a control element 106, which is, for example, an insulated-gate bipolar transistor (hereinafter referred to as IGBT), arranged to control the light emitting action of the flash tube 105 performed by consuming the electric charge accumulated in the main capacitor 102.

Further, the flash apparatus includes also a self-maintaining switch element 107, such as a thyristor, which is connected to both ends of the coil 104 in the forward direction, transistors 108 and 109 which are arranged to control the on- and off-actions of the thyristor 107, resistors 110 and 111, a capacitor 112 which is parallel-connected to the resistor 111, a control circuit 113 which is arranged to control the on- and off-actions of the transistor 109, a trigger circuit 114 which is arranged to excite the flash tube 105, a light-emission control circuit 115 which is arranged to control the action of the IGBT 106, and a diode 116 which is connected, in the reverse direction, to a series circuit composed of the coils 103 and 104 and the flash tube 105.

The coils 103 and 104 and the thyristor 107 are provided for controlling the rise characteristic of a discharge current of the electric charge of the main capacitor 102 flowing through the flash tube 105 at the time of discharge, so as to control the rise characteristic of light emitted from the flash tube 105.

More specifically, either a first discharge path in which only the coil 103 is inserted or a second discharge path in which both the coils 103 and 104 are inserted and which differs in impedance value from the first discharge path is selected as a path for the discharge of the electric charge of the main capacitor 102 through the flash tube 105, in accordance with the on- and off-actions of the thyristor 107. By virtue of this selection of the discharge path, the light emitting mode of the flash tube 105 can be selectively controlled between a normal light emission mode in which the waveform of light emission has a steep rise characteristic and a continuous light emission mode in which the waveform of light emission has a gentle rise characteristic and the light emission is continuously repeated at a high speed, i.e., the flat light emission mode.

With the flash apparatus configured in the above-stated manner, in setting the normal light emission mode, the transistor 109 is first made to be turned on by a control signal outputted from the control circuit 113. This causes, through the transistor 108, the resistor 110, etc., a turn-on voltage to be supplied to a gate, serving as a control electrode, of the thyristor 107, so that the thyristor 107 is turned on.

In this state, when the flash tube 105 is excited by the action of the trigger circuit 114 and the IGBT 106 which is a control element is turned on by the light-emission control circuit 115, the electric charge accumulated in the main capacitor 102 is discharged to the flash tube 105 through the coil 103, the thyristor 107 and the IGBT 106. In other words, the first discharge path, in which the coil 104 is not inserted, is thus selected as the discharge path for the main capacitor 102. The flash tube 105 then emits light by consuming the electric charge of the main capacitor 102 discharged through the first discharge path. At a result, the waveform of light emission of the flash tube 105 comes to have a steep rise characteristic.

In setting the flat light emission mode, on the other hand, the transistor 109 is made to be turned off by stopping the supply of a signal from the control circuit 113, so that any turn-on voltage is prevented from being applied to the gate, which is a control electrode, of the thyristor 107, in such a way as to keep the thyristor 107 in an off-state.

Under this condition, when the flash tube 105 is excited and the IGBT 106 which is a control element is turned on, the electric charge of the main capacitor 102 is discharged to the flash tube 105 through the coils 103 and 104 and the IGBT 106 without passing through the thyristor 107, unlike in the case of the normal light emission mode described above. In other words, the second discharge path in which the coils 103 and 104 are inserted is selected as the discharge path for the main capacitor 102. The flash tube 105 then emits light by consuming the electric charge of the main capacitor 102 discharged through the second discharge path. As a result, the waveform of light emission of the flash tube 105 has a gentle rise characteristic.

However, during the setting of the flat light emission mode in which the electric charge of the main capacitor 102 is discharged through the second discharge path by keeping the thyristor 107 in an off-state, if the cycle of the flat light emission is such a cycle that the next period of light emission begins while a gas which is sealed in the flash tube 105 still remains in an ionized state in a terminating stage of the last period of light emission although light is no longer emitted, the thyristor 107 might erroneously be turned on by a voltage induced at the coils 103 and 104 when the IGBT 106 which is a control element is turned on in the second and subsequent periods of light emission.

In the case of the flat light emission in the above-stated cycle, the first period of light emission can be made in a normal manner, because no energy has been accumulated as yet at the coils 103 and 104 to cause any fluctuations in potential between the cathode and the anode and between the cathode and the gate of the thyristor 107 due to the turning-on action of the IGBT 106.

However, when the IGBT 106 is turned on for the second period of light emission, the turning-on action of the IGBT 106 causes an abrupt drop of the cathode potential of the thyristor 107 to a ground level, so that a counter electromotive force induced at the coil 103 when the IGBT 106 is turned off to terminate the first period of light emission and a counter electromotive force generated at the coil 104 due to the sudden supply of energy from the main capacitor 102 are applied between the cathode and the anode and between the cathode and the gate of the thyristor 107.

Accordingly, the potential between the cathode and the anode of the thyristor 107 and the potential between the cathode and the gate of the thyristor 107 rise. When the rise of potential between the cathode and the gate comes to exceed the turn-on voltage Vg of the thyristor 107, the thyristor 107 is erroneously turned on, despite the fact that the thyristor 107 is not normally controlled to be turned on based on the turning-on action of the transistor 109 by the control circuit 113.

If the cycle of the flat light emission is such a cycle that the next period of light emission begins while a gas which is sealed in the flash tube 105 still remains in an ionized state although light is no longer emitted, the thyristor 107 remains in the erroneously turned-on state since a current flows to the thyristor 107 through the flash tube 105 which is in the ionized state.

With the thyristor 107 erroneously turned on, the electric charge of the main capacitor 102 is discharged to the flash tube 105 through the first discharge path without passing through the coil 104. The waveform of light emission of the flash tube 105 then comes to have a steep rise characteristic. In other words, the waveform of light emission of the flash tube 105 fails to become the waveform having a gentle rise characteristic normally expected to be obtained by the discharge through the second discharge path including the coil 104 in the flat light emission mode. As a result, it becomes impossible to carry out a flat light emitting action in a stable manner. Besides, in such a case, the IGBT 106 which is a control element tends to be broken with the discharge current of the steep rise characteristic repeatedly caused to flow to the IGBT 106.

FIG. 6 is an electric circuit diagram showing an example of a flash apparatus which is arranged to permit selection of the flat light emission mode and which uses, as a trigger starting switch element, a thyristor which is one of self-maintaining switch elements. In FIG. 6, all component elements denoted by the same reference numerals as in FIG. 5 have the same functions as the corresponding component elements of the flash apparatus shown in FIG. 5. Further, in this example, the flash apparatus does not include the thyristor 107 for switching of coils shown in FIG. 5.

In the case of the flash apparatus shown in FIG. 6, a series circuit composed of the coil 103 which is a current limiting element, the flash tube 105 and the IGBT 106 is connected to both ends of the main capacitor 102. The flash apparatus is provided with a trigger capacitor 117, a trigger transformer 118, a trigger thyristor 119 which is a self-maintaining switch element, and a resistor 120. To the gate, which is a control electrode, of the trigger thyristor 119, is connected a trigger generating circuit 121 for supplying a turn-on voltage (trigger signal) to the trigger thyristor 119 through a capacitor 122 and a resistor 123. Further, a diode 124 is connected between the cathode of the flash tube 105 and the trigger capacitor 117 for the purpose of quickly charging the trigger capacitor 117.

In the flash apparatus shown in FIG. 6, when the IGBT 106 is turned on by the light-emission control circuit 115 and the trigger thyristor 119 is turned on by the turn-on voltage output of the trigger generating circuit 121, the electric charge of the trigger capacitor 117 is discharged through the thyristor 119, the IGBT 106 and the trigger transformer 118. Then, the flash tube 105 is excited (i.e., the trigger action is effected) by a high voltage induced by the above discharge on the secondary winding side of the trigger transformer 118. The flash tube 105 is thus caused to emit light by consuming the electric charge of the main capacitor 102.

The light emitting action of the flash tube 105 comes to a stop when the IGBT 106 is turned off by the light-emission control circuit 115 at a suitable point of light emitting process of the flash tube 105.

At this point of time, the flash tube 105 does not instantly return to its stable initial state in which the inside-sealed gas of the flash tube 105 is not in an ionized state. The flash tube 105 returns to the initial state through a state in which, although no light is emitted, the inside-sealed gas still remains in the ionized state and a certain amount of current can be allowed to flow.

While the flash tube 105 is still in the process of returning to the initial state, therefore, the trigger capacitor 117 is charged with a current flowing through the flash tube 105 in the ionized state, the diode 124 and the trigger capacitor 117. Since the charging action on the trigger capacitor 117 is accomplished very quickly as it is performed through a charging path which does not include the resistor 120, which is an element of a high impedance value.

With the flash apparatus configured in the above-stated manner, the flash tube 105 can be normally excited by the discharging of the trigger capacitor 117 even when the next light emission is to be made in a very short period of time after the current light emission. In other words, the flash apparatus configured in the above-stated manner is arranged to be capable of preventing the flash tube 105 from being not normally excited due to an insufficient charging of the trigger capacitor 117.

With the flash apparatus set in the flat light emission mode, on the other hand, if the light emission by the flash tube 105 is to be repeated for second and subsequent periods in such a repeating cycle that the light emission of the current period begins while the flash tube 105 is still in the process of finishing the light emission of the preceding period and the inside-sealed gas of the flash tube 105 is still in an ionized state although no light is emitted, the flash tube 105, at the commencement of light emission for the current period, is in an ionized state in the same manner as when a trigger action is performed by discharging the trigger capacitor 117. Therefore, without necessitating the trigger action, the light emission for the current period can be allowed to start by just turning on the IGBT 106 which is a control element.

Therefore, the supply of the above-stated turn-on voltage to the gate of the trigger thyristor 119 by the trigger generating circuit 121 is arranged to be made only for the first period of light emission and to be not made for the second and subsequent periods of light emission. Such an arrangement effectively prevents generation of noises due to the triggering action performed by discharging the trigger capacitor 117 and thus has been considered to be advantageous for the electric circuit of the flash apparatus.

However, even with the flash apparatus arranged in this manner, there still remains the possibility that the trigger thyristor 119 might be erroneously caused to turn on by the charging voltage of the trigger capacitor 117 which is quickly charged, when the IGBT 106 is turned on.

An operating state in which an erroneous on-state of the trigger thyristor 119 is caused to occur as mentioned in the above manner is described below with reference to FIGS. 7(*a*), 7(*b*) and 7(*c*).

FIG. 7(*a*) is a timing chart showing an operating state of the IGBT 106. FIG. 7(*b*) is a timing chart showing a state of potential obtained between the ground and an anode, which is an electrode on the high potential side, of the trigger thyristor 119, which is a self-maintaining switch element. FIG. 7(*c*) is a timing chart showing a state of potential of the trigger thyristor 119 obtained between a cathode which is an electrode on the low potential side and a gate which is a control electrode.

The IGBT 106 is turned on at a point of time T0 as shown in FIG. 7(*a*). After that, when a driving voltage which is equal to or higher than a turn-on voltage Vg of the trigger thyristor 119 is supplied to the gate of the trigger thyristor 119 from the trigger generating circuit 121 between points of time T1 and T2, as shown in FIG. 7(*c*), the trigger thyristor 119 is turned on at the point of time T1. Therefore, as shown in FIG. 7(*b*), the potential between the ground and the anode of the trigger thyristor 119 abruptly drops to the ground level following a trigger action on the flash tube 105 by the discharge of the trigger capacitor 117 made through the trigger thyristor 119 which is turned on. Meanwhile, the flash tube 105 is caused by the above-stated trigger action to emit light by consuming the electric charge of the main capacitor 102.

When the IGBT 106 is turned off by the light-emission control circuit 115 at a suitable point of time T3 as shown in FIG. 7(*a*) while the flash tube 105 is in process of light emission, the light emitting action of the flash tube 105 comes to a stop and, at the same time, the trigger capacitor 117 is quickly charged through the flash tube 105 which is in an ionized state, etc. Accordingly, the potential between the ground and the anode of the trigger thyristor 119 comes to rise according to the progress of the charging action, as shown in FIG. 7(*b*).

Then, to make light emission for the next period, when the IGBT 106 is again turned on at a time point T4 at which the flash tube 105 is still in an ionized state, the flash tube 105 again begins to emit light by consuming the electric charge of the main capacitor 102.

In this instance, since the potential level of the cathode of the trigger thyristor 119 abruptly drops to the ground level at the same time, the charging voltage of the trigger capacitor 117 comes to be applied between the anode and cathode of the trigger thyristor 119. As a result of this, an upward change of potential is caused by a floating capacity component of the trigger thyristor 119 to take place between the cathode and gate of the trigger thyristor 119 after a point of time T4, as shown in FIG. 7(*c*).

Therefore, if the trigger capacitor 117 at the point of time T4 has been charged up to a charging voltage equal to or higher than a voltage Vt which enables a voltage equal to or higher than the turn-on voltage Vg to be applied to the gate of the trigger thyristor 119 by the floating capacity component of the trigger thyristor 119, the upward change of potential taking place after the point of time T4 between the cathode and gate of the trigger thyristor 119 reaches at least the turn-on voltage Vg at a point of time T5, as shown in FIG. 7(*c*). As a result of this, the trigger thyristor 119 is erroneously turned on, despite the fact that the normal turn-on control by supplying a turn-on voltage from the trigger generating circuit 121 is not performed at the point of time T5.

When the trigger thyristor 119 is turned on at the point of time T5, although the turning-on is an erroneous action, the potential between the ground and anode of the trigger thyristor 119 and the potential between the cathode and gate of the trigger thyristor 119 drop, after the point of time T5, in a characteristic manner shown in FIGS. 7(*b*) and 7(*c*). At the same time, a trigger action is performed by discharging, through the trigger transformer 118, the electric charge of the trigger capacitor 117 which has been quickly charged. This trigger action generates a noise.

This trigger action is unnecessary in view of the light emitting cycle, as mentioned above. However, after the trigger capacitor 117 is quickly charged up to the above-stated voltage Vt or above, the trigger action takes place every time the IGBT 106 is turned on for light emission of the next period. Under such a condition, a noise resulting from the trigger action tends to cause the light-emission control circuit 115 to malfunction, thereby making it impossible to adequately carry out a flat light emitting action in a stable manner.

Further, if the action of turning on the IGBT 106 for light emission of the next period is performed at a point of time when the charging voltage obtained by the quick charging action on the trigger capacitor 117 is lower than the above-stated voltage Vt, the trigger thyristor 119 is not immediately caused to be erroneously turned on by the turning-on of the IGBT 106. However, even in that case, since the quick charging action on the trigger capacitor 117 is carried on while the IGBT 106 is in an off-state, the charging voltage gradually rises. Therefore, when the IGBT 106 is turned on after the charging voltage reaches or exceeds the voltage Vt, the turning-on action of the IGBT 106 causes the trigger thyristor 119 to be erroneously turned on. Therefore, a noise would result also from the erroneous action of the trigger thyristor 119 like in the case of the first example of operation described in the foregoing, although the erroneous actions of the examples described above differ from each other in turning-on timing.

BRIEF SUMMARY OF THE INVENTION

It is an object of the invention to provide a flash apparatus which is capable of performing a high-speed repeating light emitting action and which is capable of preventing a self-maintaining switch element used for various purposes from being caused to erroneously act by the high-speed repeating light emitting action.

Another object of the invention is to provide a flash apparatus which is capable of performing a high-speed repeating light emitting action and which is capable of stably carrying out the light emitting action by preventing a self-maintaining switch element used as a switch element for controlling a coil connecting state (coil switch-over) for a discharge loop for a main capacitor from being caused to erroneously act by the high-speed repeating light emitting action.

To attain the above objects, in accordance with an aspect of the invention, there is provided a flash apparatus which comprises a main capacitor, a flash tube, a first discharge path disposed between the main capacitor and the flash tube and including a self-maintaining switch element having a high-potential-side electrode connected to the main capacitor and a low-potential-side electrode connected to the flash tube, a second discharge path disposed in parallel with the first discharge path and having an impedance value different from that of the first discharge path, a control circuit which selects one of the first discharge path and the second discharge path by turning on or off the self-maintaining switch element in emitting flash light and which causes electric charge accumulated in the main capacitor to be discharged through the selected one of the first discharge path and the second discharge path, and a bias circuit which, when the first discharge path is selected, allows the control circuit to turn on the self-maintaining switch element by applying a control signal to a control electrode of the self-maintaining switch element, and which, when the second discharge path is selected, reverse-biases the control electrode of the. self-maintaining switch element.

A further object of the invention is to provide a flash apparatus which is capable of performing at a high-speed repeating light emitting action and which is capable of stably carrying out a flat light emitting action without generating any noise by preventing a self-maintaining switch element used as a switch element for controlling the action timing of a trigger circuit (start of triggering) from being caused to erroneously act by the high-speed repeating light emitting action.

To attain the above objects, in accordance with another aspect of the invention, there is provided a flash apparatus which comprises a main capacitor, a flash tube having a positive electrode connected to a positive electrode of the main capacitor, a control element which is connected to a negative electrode of the flash tube and which repeats turning-on and turning-off operations to cause the flash tube to make repeating light emission, a trigger capacitor, a self-maintaining switch element having a high-potential-side electrode connected to one of electrodes of the trigger capacitor and a low-potential-side electrode connected to the negative electrode of the flash tube, a trigger generating circuit which generates a trigger signal to be applied to a control electrode of the self-maintaining switch element when the control element turns on for the first time, and a bias circuit which, when the trigger generating circuit generates the trigger signal, allows the trigger signal to be supplied to the control electrode of the self-maintaining switch element to trigger the flash tube by discharging electric charge of the trigger capacitor through the self-maintaining switch element and the control element, and which, when the control element is in an off-state, reverse-biases the control electrode of the self-maintaining switch element.

These and other objects and features of the invention will become apparent from the following detailed description of preferred embodiments thereof taken in conjunction with the accompanying drawings.

BRIEF DESCRIPTION OF THE SEVERAL VIEWS OF THE DRAWING

FIG. 3 is an electric circuit diagram showing essential parts of a flash apparatus according to another embodiment of the invention.

FIGS. 4(*a*) to 4(*c*) are timing charts for explaining operations of the embodiment shown in FIG. 3, with FIG. 4(*a*) showing an operating state of an IGBT, FIG. 4(*b*) showing the state of potential obtained between the ground and an anode, which is an electrode on the high potential side, of a trigger thyristor serving as a self-maintaining switch element, and FIG. 4(*c*) showing the state of potential obtained between a cathode, which is an electrode on the low potential side, of the trigger thyristor and a gate, which is a control electrode, of the trigger thyristor.

FIG. 6 is an electric circuit diagram showing another example of a conventional flash apparatus arranged to permit selection of a flat light emission mode and to have a thyristor which is a self-maintaining switch element used as a switch element for starting a trigger action.

FIGS. 7(*a*) to 7(*c*) are timing charts for explaining operations of the flash apparatus shown in FIG. 6, with FIG. 7(*a*) showing an operating state of an IGBT, FIG. 7(*b*) showing the state of potential obtained between the ground and an anode, which is an electrode on the high potential side, of a trigger thyristor serving as a self-maintaining switch element, and FIG. 7(*c*) showing the state of potential obtained between a cathode, which is an electrode on the low potential side, of the trigger thyristor and a gate, which is a control electrode, of the trigger thyristor.

DETAILED DESCRIPTION OF THE INVENTION

Hereinafter, preferred embodiments of the invention will be described in detail with reference to the drawings.

Figure 1:
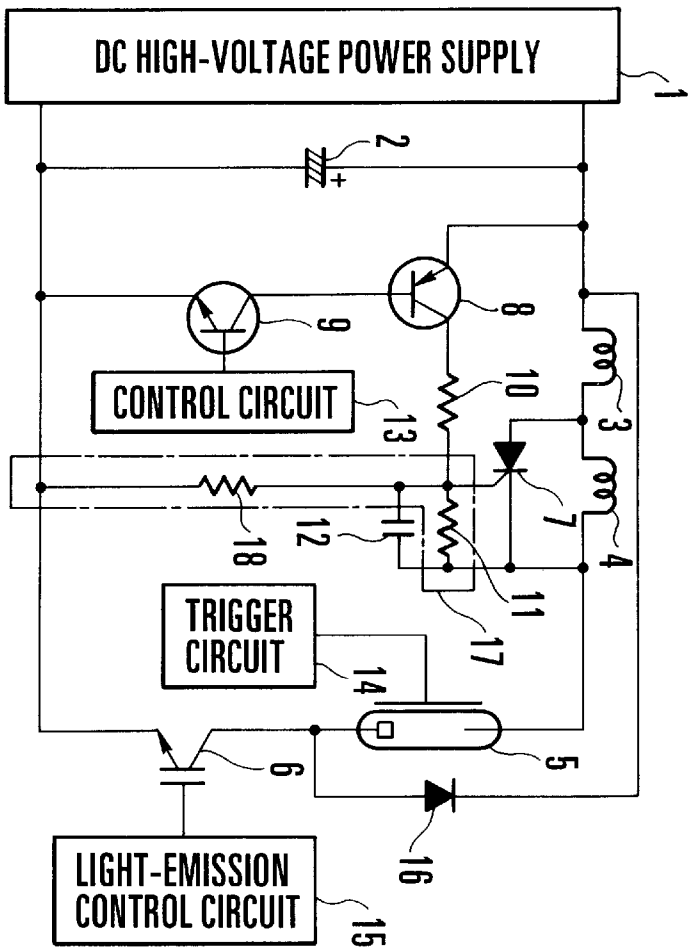
FIG. 1 is an electric circuit diagram showing essential parts of a flash apparatus according to an embodiment of the invention.

FIG. 1 is an electric circuit diagram showing essential parts of a flash apparatus according to a first embodiment of the invention. The flash apparatus according to the first embodiment has a DC high-voltage power supply 1 which is composed of, for example, a DC low-voltage power source such as a battery and a D/C converter circuit, and a main capacitor 2 which is connected to the two ends of the DC high-voltage power supply 1. To the two ends of the main capacitor 2 is connected a series circuit composed of a plurality of coils (current-limiting elements) 3 and 4, a flash tube 5, and an IGBT 6 which is a control element arranged to control the light emitting action of the flash tube 5 performed by consuming the electric charge of the main capacitor 2. The flash apparatus according to the first embodiment is further provided with a thyristor 7 which is a self-maintaining switch element connected to the two ends of the coil 4 in the forward direction, transistors 8 and 9 which are arranged to control the on- and off-actions of the thyristor 7, resistors 10 and 11, a capacitor 12 which is connected in parallel with the resistor 11 (first resistor), and a control circuit 13 which is arranged to control the on- and off-actions of the transistor 9. The flash apparatus according to the first embodiment is further provided with a trigger circuit 14 which is arranged to excite the flash tube 5, a light-emission control circuit 15 which is arranged to control the action of the IGBT 6, and a diode 16 which is connected, in the reverse direction, to a series circuit composed of the coils 3 and 4 and the flash tube 5.

The coils 3 and 4 and the thyristor 7 are provided for the rise characteristic of a discharge current of the electric charge of the main capacitor 2 flowing through the flash tube 5 at the time of discharge, so as to control the rise characteristic of light emitted from the flash tube 5.

More specifically, either a first discharge path in which only the coil 3 is inserted or a second discharge path in which both the coils 3 and 4 are inserted and which differs in impedance value from the first discharge path is selected as a path for the discharge of the electric charge of the main capacitor 2 through the flash tube 5, in accordance with the on- and off-actions of the thyristor 7. By virtue of this selection of the discharge path, the light emitting mode of the flash tube 5 can be selectively controlled between a normal light emission mode in which the waveform of light emission has a steep rise characteristic and a continuous light emission mode in which the waveform of light emission has a gentle rise characteristic and the light emission is continuously repeated at a high speed, i.e., the flat light emission mode.

The flash apparatus according to the first embodiment is further provided with a resistor 18 (second resistor) which is connected in series to the resistor 11 and which is connected between the control electrode of the thyristor 7 and the terminal on the low potential side (ground side) of the main capacitor 2. It is to be noted that the resistor 11 and the resistor 18 constitute a bias circuit 17.

Accordingly, between the cathode and gate of the thyristor 7, there is always applied a voltage arising at the two ends of the resistor 11 among voltages obtained by dividing a charging voltage of the polarity, shown in FIG. 1, of the main capacitor 2 by the coils 3 and 4 and the bias circuit 17. The voltage arising at the two ends of the resistor 11 is applied in such a direction as to raise the potential of the cathode of the thyristor 7 with respect to the potential of the gate thereof. Therefore, the gate of the thyristor 7 is reverse-biased.

The flash apparatus according to the first embodiment operates as described below. The operation in the normal light emission mode is first described.

The transistor 9 is made to be turned on by a control signal from the control circuit 13. By this turning-on of the transistor 9, a turn-on voltage is supplied through the transistor 8, the resistor 10, etc., to the gate, which is a control electrode, of the thyristor 7, so that the thyristor 7 is turned on.

Under this condition, when the flash tube 5 is excited by the action of the trigger circuit 14 and the IGBT 6, which is a control element, is turned on by the light-emission control circuit 15, the charging electric charge of the main capacitor 2 is discharged to the flash tube 5 through the coil 3, the thyristor 7 and the IGBT 6. In other words, the first discharge path in which the coil 4 is not inserted is selected as the path of discharging the electric charge of the main capacitor 2. The flash tube 5 then emits light by consuming the electric charge of the main capacitor 2 discharged through the first discharge path. In this instance, the waveform of light emission of the flash tube 5 has a steep rise characteristic.

The operation of the flash apparatus according to the first embodiment in the flat light emission mode, in which a light emitting action is repeated in such a cycle that the light emission of the next period begins while the inside-sealed gas of the flash tube 5 still remains in an ionized state after the light emission of one period, is next described as follows.

Figure 5:
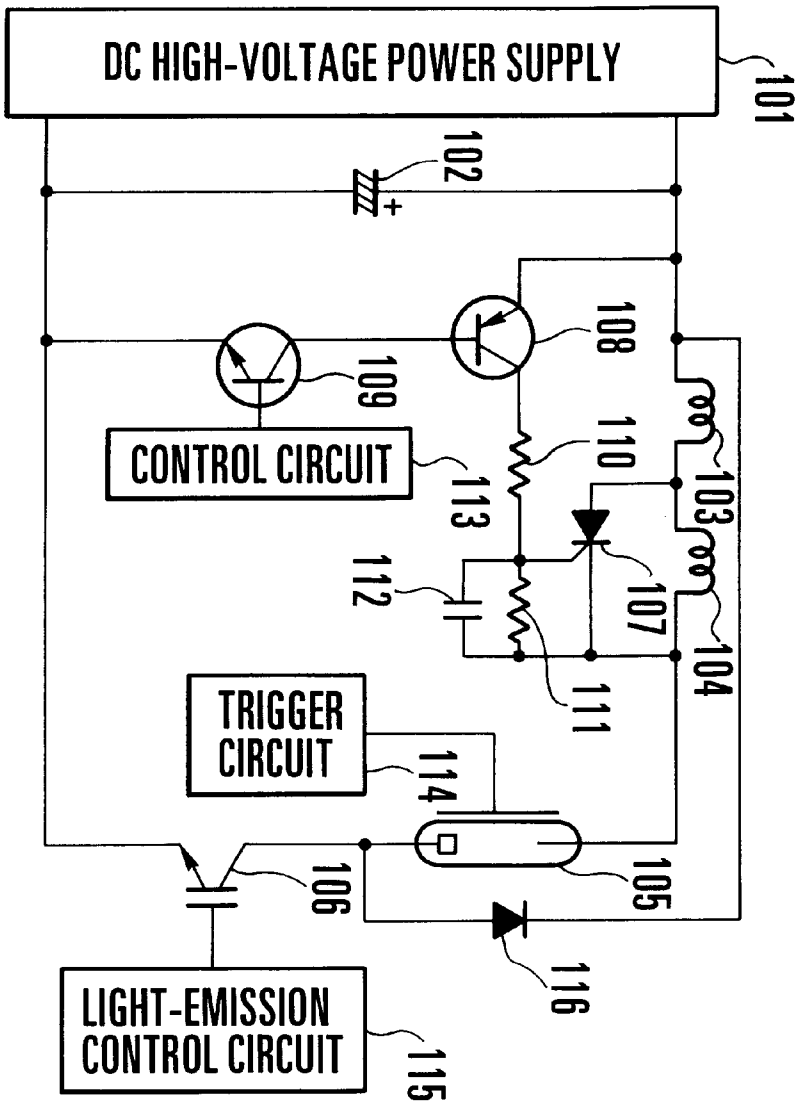
FIG. 5 is an electric circuit diagram showing an example of a conventional flash apparatus arranged to permit selection of a flat light emission mode and to have a thyristor which is a self-maintaining switch element used as a switch element for coil switch-over.

Unlike the potential between the cathode and gate of the thyristor 107 of the prior art example shown in FIG. 5, the potential between the cathode and gate of the thyristor 7 in the first embodiment is controlled, by the provision of the bias circuit 17, to be in such a state of potential as to reverse-bias the gate of the thyristor 7.

With the gate of the thyristor 7 thus reverse-biased to have the thyristor 7 in an off-state, when the flash tube 5 is excited and the IGBT 6, which is a control element, is turned on by the light-emission control circuit 15, the charging electric charge of the main capacitor 2 is discharged to the flash tube 5 through the coils 3 and 4 and the IGBT 6 without passing through the thyristor 7, unlike in the case of the normal light emission mode. In other words, the second discharge path in which both the coils 3 and 4 are inserted is selected as the path of discharging the main capacitor 2. Then, the flash tube 5 emits light by consuming the electric charge of the main capacitor 2 discharged through the second discharge path. As a result, the waveform of light emission of the flash tube 7 comes to have a gentle rise characteristic. The light emission of the first period is thus made in the above manner.

When the IGBT 6 is turned on for the light emission of the second and subsequent periods, a counter electromotive force induced to the coil 3 when the IGBT 6 is turned off at the end of the light emission of the first period or the light emission of the preceding period and a counter electromotive force arising at the coil 4 are applied to the thyristor 7 by an abrupt drop of the cathode potential of the thyristor 7 to the ground level. This causes both the potential between the cathode and anode of the thyristor 7 and the potential between the cathode and gate of the thyristor 7 to rise.

However, in the case of the first embodiment, the upward change of potential between the cathode and gate of the thyristor 7 takes place from such a state that the gate of the thyristor 7 is reverse-biased by the bias circuit 17. Therefore, the value of the upward change never reaches the turn-on voltage Vg of the thyristor 7. Besides, since the capacitor 12 is connected in parallel with the resistor 11 between the gate and cathode of the thyristor 7, the rise of potential of the gate of the thyristor 7, with respect to the cathode of the thyristor 7, is effectively suppressed when the IGBT 6 is turned on for the second time and thereafter. Therefore, the thyristor 7 is never caused to be erroneously turned on by the induced voltages of the coils 3 and 4 which are to be applied when the IGBT 6 is turned on.

Since the thyristor 7 is not erroneously turned on, the potential between the cathode and anode of the thyristor 7, after the upward change of potential, gradually lowers until the IGBT 6 is turned off, and is then caused to greatly change in the reverse direction by the counter electromotive force induced at the coil 4 when the IGBT 6 is turned off.

Further, since the thyristor 7 is not erroneously turned on, the potential between the cathode and gate of the thyristor 7 stops to rise according to the downward change of potential between the cathode and anode of the thyristor 7, and after that, comes to gradually lower.

As a result, when the flash apparatus according to the first embodiment is in the flat light emission mode in which the thyristor 7 is kept in the off-state, the electric charge of the main capacitor 2 is discharged always through the second discharge path in which both the coils 3 and 4 are inserted. Therefore, the flat light emitting action can be stably carried out.

Figure 2:
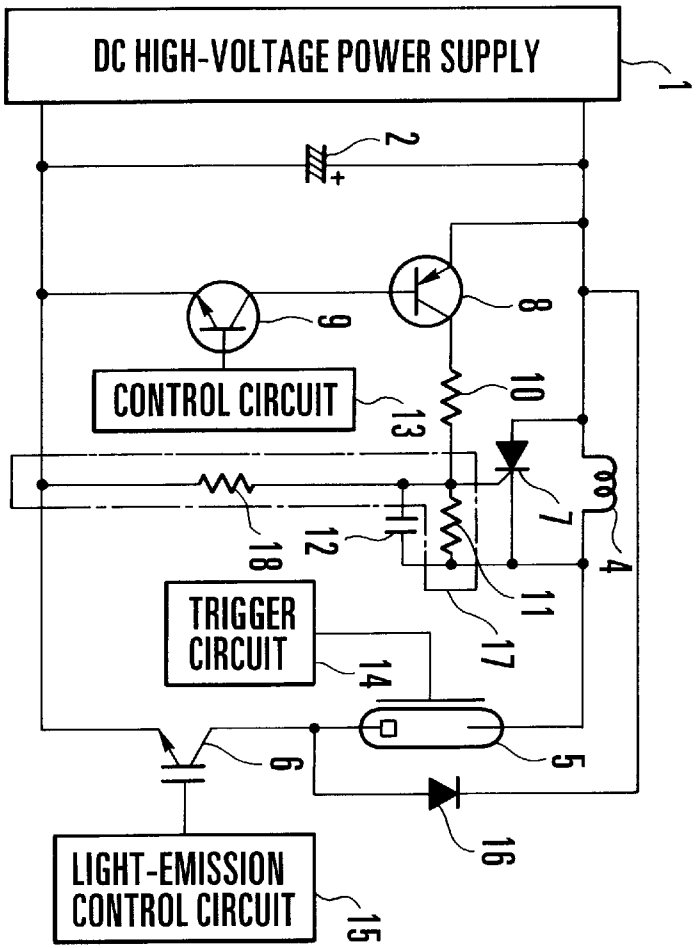
FIG. 2 is an electric circuit diagram showing essential parts of a modification example of the flash apparatus arranged according to the embodiment of the invention.

Further, the first embodiment has been described as arranged to discharge the electric charge of the main capacitor 2 through only the coil 3 for the normal light emitting action and through both the coils 3 and 4 for the flat light emitting action. The arrangement of the first embodiment, however, may be changed as shown in FIG. 2 which shows an example of modification. The modification is arranged, as shown in FIG. 2, to have the charging electric charge of the main capacitor 2 discharged through no coil in the normal light emission mode and through only the coil 4 in the flat light emission mode.

As has been described above, in the flash apparatus according to the first embodiment, one of self-maintaining switch elements used in the flash apparatus for selecting a path of discharging the electric charge of the main capacitor is effectively prevented from being erroneously turned on in the flat light emission mode. The arrangement, therefore, enables the flash apparatus to stably carry out a flat light emitting action.

FIG. 3 is an electric circuit diagram showing essential parts of a flash apparatus according to a second embodiment of the invention. In FIG. 3, all parts of the second embodiment that function in the same manner as the parts of the first embodiment are indicated by the same reference numerals as those of FIGS. 1 and 2.

The flash apparatus according to the second embodiment has, as in the first embodiment shown in FIGS. 1 and 2, a DC high-voltage power supply 1 and a main capacitor 2 which is connected to the two ends of the DC high-voltage power supply 1. To the two ends of the main capacitor 2 is connected a series circuit composed of a coil (current-limiting element) 3, a flash tube 5 and an IGBT 6.

The flash apparatus according to the second embodiment is further provided with a trigger capacitor 19, a trigger transformer 20, a trigger thyristor 21 which is a self-maintaining switch element, a resistor 22, a trigger generating circuit 23 which is arranged to supply a turn-on voltage (trigger signal) of the trigger thyristor 21 through a first resistor 25 and a capacitor 24 parallel-connected between a gate, which is a control electrode, of the trigger thyristor 21 and a cathode, which is an electrode on the low potential side, of the trigger thyristor 21, a diode 26 for quickly charging the trigger capacitor 19, and a second resistor 28 which is connected between the gate of the trigger thyristor 21 and an electrode on the low potential side of the main capacitor 2.

It is to be noted that the first resistor 25 and the second resistor 28 constitute a bias circuit 27. Further, the second resistor 28 serves as reverse-bias means for reverse-biasing the part between the gate and cathode of the trigger thyristor 21 when the IGBT 6 is in an off-state.

With the flash apparatus provided with the bias circuit 27, when the IGBT 6 is in an off-state, there is applied, between the cathode and gate of the trigger thyristor 21, a voltage arising at the two ends of the resistor 25 among voltages obtained by dividing a charging voltage of the polarity, shown in FIG. 3, of the main capacitor 2 by the coil 3, the flash tube 4 in an ionized state and the bias circuit 27. The voltage arising at the two ends of the resistor 25 is applied in such a direction as to raise the potential of the cathode of the trigger thyristor 21 with respect to the potential of the gate thereof. The gate of the trigger thyristor 21 is, therefore, reverse-biased by the voltage arising at the two ends of the resistor 25 when the IGBT 6 is in the off-state as mentioned above.

The flash apparatus according to the second embodiment operates as described below with reference to FIGS. 4(*a*) to 4(*c*). FIGS. 4(*a*) to 4(*c*) are timing charts for explaining operations of the flash apparatus in the flat light emission mode having such a cycle that the flash emission of the next period begins while an inside-sealed gas of the flash tube 5 still remains in an ionized state after the light emission of one period. FIG. 4(*a*) shows the operating state of the IGBT 6, FIG. 4(*b*) shows a state of potential between the ground (i.e., an electrode on the low potential side of the main capacitor 2) and the anode of the trigger thyristor 21, and FIG. 4(*c*) shows a state of potential between the cathode and gate of the trigger thyristor 21.

Referring to FIG. 4(*a*), the light-emission control circuit 15 causes the IGBT 6 to be turned on at a point of time T0. After that, when the trigger generating circuit 23 outputs a turn-on voltage to cause the trigger thyristor 21, which is a self-maintaining switch element, to be turned on during a period between points of time T1 and T2, as shown in FIG. 4(*c*), the charging electric charge of the trigger capacitor 19 is discharged through the trigger thyristor 21, the IGBT 6 and the trigger transformer 20. Then, the flash tube 5 is excited, i.e., triggered, by a high voltage induced on the secondary winding side of the trigger transformer 20. As a result, the flash tube 5 emits light by consuming the electric charge of the main capacitor 2.

While the flash tube 5 is in process of light emission, when the IGBT 6 is turned off by the light-emission control circuit 15 at a suitable point of time T3 as shown in FIG. 4(*a*), the flash tube 5 returns to its initial state through a transient state in which the inside-sealed gas of the flash tube 5 still remains in an ionized state, although light is no longer emitted, and a certain amount of current can be allowed to flow through the flash tube 5. While the flash tube 5 is in process of returning to the initial state, a current is allowed to flow through the flash tube 5 in the ionized state, the diode 26 and the trigger capacitor 19. The trigger capacitor 19 is quickly charged by this flow of current.

As a result, the potential between the ground and the anode of the trigger thyristor 21 rises in response to the charging process as shown in FIG. 4(*b*). At the same time, as shown in FIG. 4(*c*), the bias circuit 27 acts as described above to control the potential between the cathode and gate of the trigger thyristor 21 to be in such a state that the gate of the trigger thyristor 21 is reverse-biased. In this respect, the state of potential thus obtained differs from the potential state obtained, as shown in FIG. 7(*c*), between the cathode and gate of the trigger thyristor 119 of the flash apparatus of the prior art shown in FIG. 6.

When the IGBT 6 is again turned on to make the light emission of the next period at a point of time T4 at which the flash tube 5 is still in an ionized state, the flash tube 5 again begins to emit light by consuming the electric charge of the main capacitor 2. At the same time, the level of potential at the cathode of the trigger thyristor 21 steeply drops to the ground level. This steep drop causes the charging voltage of the trigger capacitor 19 to be applied between the anode and cathode of the trigger thyristor 21. As a result, a floating capacity component possessed by the trigger thyristor 21 causes an upward change of potential between the cathode and gate of the trigger thyristor 21 during a period after the point of time T4. The second embodiment is the same, in respect of this point, as the flash apparatus of the prior art shown in FIG. 6.

In the case of the second embodiment, however, the upward change of potential takes place from such a state that the gate of the trigger thyristor 21 is reverse-biased by the bias circuit 27. Therefore, the upward change of potential never reaches the level of the turn-on voltage Vg of the trigger thyristor 21, as shown at the point of time T4 and thereafter in FIG. 4(*c*).

The potential between the cathode and gate of the trigger thyristor 21 is caused, after the IGBT 6 is turned on at the point of time T4, to come to rise by the floating capacity component possessed by the trigger thyristor 21. However, after charging with the floating capacity component, the potential comes to change toward a cathode potential to be obtained by turning on the IGBT 6. Therefore, the potential between the cathode and gate of the trigger thyristor 21 never rises up to the turn-on voltage Vg, which has a higher potential than the cathode potential.

Further, the potential between the cathode and gate of the trigger thyristor 21 changes to a state of being reverse-biased by the action of the bias circuit 27 when the IGBT 6 is turned off again. Besides, since the capacitor 24 is connected between the gate and cathode of the trigger thyristor 21 in parallel with the resistor 25, the capacitor 24 acts to suppress the rise of potential of the gate with respect to the cathode as a result of the abrupt change of potential between the anode and cathode of the trigger thyristor 21 when the IGBT 6 is again turned on.

Therefore, the trigger thyristor 21 is never caused to be erroneously turned on by the supply of charging voltage of the trigger capacitor 19 when the IGBT 6 is turned on. Hence, according to the arrangement of the second embodiment, an unnecessary trigger action (noise) due to an erroneous action of a trigger thyristor, like in the case of the flash apparatus of the prior art shown in FIG. 6, can be effectively prevented. The arrangement of the second embodiment, therefore, enables a flat light emitting action to be stably carried out.

Further, since the trigger thyristor 21 is never erroneously turned on and the trigger capacitor 19 is also not discharged after the point of time T3, the potential between the ground and the anode of the trigger thyristor 21 gradually rises, as shown in FIG. 4(*b*), until the trigger capacitor 19 is completely charged, except when the IGBT 6 is turned on.

As has been described above, the flash apparatus according to the second embodiment is arranged to reverse-bias the control electrode of the self-maintaining switch element (trigger thyristor) used for controlling the acting time of the trigger circuit, when the control element (IGBT) is in an off-state. By virtue of this arrangement, the self-maintaining switch element can be prevented from being erroneously turned on even if the trigger capacitor is rapidly charged when the control element is turned on in carrying out a flat light emitting action. In other words, the trigger capacitor can be prevented from being discharged when no trigger signal is supplied to the control electrode of the self-maintaining switch element. According to the arrangement of the second embodiment, therefore, a flash apparatus can be arranged to stably carry out a flat light emitting action without having any noise that otherwise tends to be brought about by an unnecessary trigger action.

While the invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A flash apparatus comprising:

a main capacitor;

a flash tube;

a first discharge path disposed between said main capacitor and said flash tube and including a self-maintaining switch element having a high-potential-side electrode connected to said main capacitor and a low-potential-side electrode connected to said flash tube;

a second discharge path formed through the flash tube, disposed in parallel with said discharge path and having an impedance value different from that of said first discharge path;

a control circuit which selects one of said first discharge path and said second discharge path by turning on or off said self-maintaining switch element in emitting flash light and which causes electric charge accumulated in said main capacitor to be discharged through the selected one of said first discharge path and said second discharge path; and a bias circuit which, when said first discharge path is selected, allows said control circuit to turn on said self-maintaining switch element by applying a control signal to a control electrode of said self-maintaining switch element, and which, when said second discharge path is selected, reverse-biases the control electrode of said self-maintaining switch element.

2. A flash apparatus according to claim 1, wherein said bias circuit includes a first resistor connected between the control electrode and the low-potential-side electrode of said self-maintaining switch element, and a second resistor connected in series with said first resistor and connected between the control electrode of said self-maintaining switch element and a low-potential-side terminal of said main capacitor.

3. A flash apparatus according to claim 2, further comprising a capacitor connected in parallel to said first resistor.

4. A flash apparatus comprising:

a plurality of current-limiting elements, disposed in series between a high-potential-side electrode of said main capacitor and a flash tube and forming a current discharge path for said main capacitor through said flash tube;

a self-maintaining switch element connected to two ends of one of said plurality of current-limiting elements in a forward direction with respect to the discharge loop; and reverse-bias means for constantly reverse-biasing a control electrode of said self-maintaining switch element.

5. A flash apparatus according to claim 4, wherein said reverse-bias means is a resistor connected between the control electrode of said self-maintaining switch element and a low-potential-side terminal of said main capacitor.

6. A flash apparatus comprising:

a current-limiting element disposed within a discharge loop for a main capacitor through a flash tube;

a self-maintaining switch element connected to two ends of said current-limiting element in a forward direction with respect to the discharge loop, one of a first discharge path in which said current-limiting element is not included and a second discharge path in which said current-limiting element is included being selected by turning on or off said self-maintaining switch element in emitting flash light; and reverse-bias means for reverse-biasing a control electrode of said self-maintaining switch element when the second discharge path is selected.

7. A flash apparatus according to claim 6, wherein said reverse-bias means is a resistor connected between the control electrode of said self-maintaining switch element and a low-potential-side terminal of said main capacitor.

8. A flash apparatus comprising:

a main capacitor;

a flash tube having a positive electrode connected to a positive electrode of said main capacitor;

a control element which is connected to a negative electrode of said flash tube and which repeats turning-on and turning-off operations to cause said flash tube to make repeating light emission;

a trigger capacitor;

a self-maintaining switch element having a high-potential-side electrode connected to one of electrodes of said trigger capacitor and a low-potential-side electrode connected directly to the negative electrode of said flash tube;

a trigger generating circuit which generates a trigger signal to be applied to a control electrode of said self-maintaining switch element which said control elements turns on for the first time; and a bias circuit which, when said trigger generating circuit generates the trigger signal, allows the trigger signal to be supplied to the control electrode of said self-maintaining switch element to trigger said flash tube by discharging electric charge of said trigger capacitor through said self-maintaining switch element and said control element, and which, when said control element is in an off-state, reverse-biases the control electrode of said self-maintaining switch element.

9. A flash apparatus according to claim 8, wherein said bias circuit includes a first resistor connected between the control electrode and the low-potential-side electrode of said self-maintaining switch element, and a second resistor connected in series with said first resistor and connected between the control electrode of said self-maintaining switch element and a negative electrode of said main capacitor.

10. A flash apparatus according to claim 9, further comprising a capacitor connected in parallel to said first resistor.

11. A flash apparatus according to one of claims 8 to 10, wherein said flash tube makes the repeating light emission in such a manner that light emission for the first time is made through a discharge loop including said trigger capacitor, said control element and said self-maintaining switch element and light emission for the second and subsequent times is made in response to the turning-on and turning-off operations of said control element.

12. A flash apparatus comprising:

a main capacitor;

a flash tube;

a control element which performs turning-on and turning-off operations, said flash tube and said control element being connected in series to said main capacitor;

a trigger circuit which includes a self-maintaining switch element having a low-potential-side electrode connected directly to a connection point between said flash tube and said control element, and which excites said flash tube by causing electric charge accumulated in a trigger capacitor to be discharged through said self-maintaining switch element, said control element and a trigger transformer, in response to the turning-on operation of said self-maintaining switch element; and reverse-bias means for reverse-biasing between a control electrode of said self-maintaining switch element and the low-potential-side electrode thereof when said control element is in an off-state.

13. A flash apparatus according to claim 12, wherein said reverse-bias means is a resistor connected between the control electrode of said self-maintaining switch element and a low-potential-side terminal of said main capacitor.

* * * * *

UNITED STATES PATENT AND TRADEMARK OFFICE

CERTIFICATE OF CORRECTION

PATENT NO. : 6,150,770
DATED : November 21, 2000
INVENTOR(S) : Shinji Hirata et al.

It is certified that error appears in the above-identified patent and that said Letters Patent is hereby corrected as shown below:

Column 2,
Line 26, delete "At a result" and insert -- As a rresult --.

Signed and Sealed this

First Day of January, 2002

*Attest:*

*Attesting Officer*

JAMES E. ROGAN
*Director of the United States Patent and Trademark Office*